US010407858B2

(12) United States Patent
Ouyang et al.

(10) Patent No.: US 10,407,858 B2
(45) Date of Patent: Sep. 10, 2019

(54) END POINT CLOSING WALL FORMING DEVICE OF EXTRUSION TYPE UNDERGROUND DIAPHRAGM WALL AND METHOD FOR OPERATING SAME

(71) Applicants: QINGDAO JINGLI ENGINEERING CO,. LTD., Qingdao (CN); Ganlin Ouyang, Qingdao (CN)

(72) Inventors: Ganlin Ouyang, Qingdao (CN); Shibao Lu, Qingdao (CN); Beibei Ouyang, Qingdao (CN)

(73) Assignee: Qingdao Jingli Engineering Co., Ltd., Qingdao, Shandong (CN)

( * ) Notice: Subject to any disclaimer, the term of this patent is extended or adjusted under 35 U.S.C. 154(b) by 0 days.

(21) Appl. No.: 15/747,148

(22) PCT Filed: Aug. 26, 2015

(86) PCT No.: PCT/CN2015/088115
§ 371 (c)(1),
(2) Date: Jan. 23, 2018

(87) PCT Pub. No.: WO2017/012169
PCT Pub. Date: Jan. 26, 2017

(65) Prior Publication Data

US 2018/0216304 A1 Aug. 2, 2018

(30) Foreign Application Priority Data

Jul. 23, 2015 (CN) ..... 2015 1 0437993

(51) Int. Cl.
*E02D 5/20* (2006.01)
*E02D 29/02* (2006.01)
(Continued)

(52) U.S. Cl.
CPC ..... *E02D 5/20* (2013.01); *E02D 5/185* (2013.01); *E02D 5/68* (2013.01); *E02D 7/20* (2013.01);
(Continued)

(58) Field of Classification Search
CPC .... E02D 5/06; E02D 5/08; E02D 5/12; E02D 5/14; E02D 7/18; E02D 7/24; E02D 29/02
See application file for complete search history.

(56) References Cited

U.S. PATENT DOCUMENTS 3,889,482 A * 6/1975 Frederick ..... E02D 5/08 173/49
4,484,835 A * 11/1984 van Klinken ..... E02D 19/18 405/129.8
(Continued)

FOREIGN PATENT DOCUMENTS

CN 101718099 * 6/2010
WO WO 9325766 * 12/1993
WO WO-2010032485 A1 * 3/2010 ..... E02D 5/04

*Primary Examiner* — Frederick L Lagman
(74) *Attorney, Agent, or Firm* — Liang Legal Group, PLLC

(57) ABSTRACT

An end point closing wall forming device of an extrusion type underground diaphragm wall comprises a main body (1) and a vibration water spraying device. The vibration water spraying device is fixedly disposed inside the main body (1). The end point closing wall forming device of an extrusion type underground diaphragm wall further comprises a separation device. The separation device is movably sheathed on the outer side of a short edge (11') of the main body (1). Also provided is a method for operating an end point closing wall forming device of an extrusion type underground diaphragm wall.

6 Claims, 11 Drawing Sheets

(51) Int. Cl.

| | |
|---|---|
| ***E02D 7/20*** | (2006.01) |
| ***E02D 5/18*** | (2006.01) |
| ***E02D 5/68*** | (2006.01) |
| *E02D 3/046* | (2006.01) |
| *E02D 7/26* | (2006.01) |
| *E02D 15/04* | (2006.01) |

(52) U.S. Cl.
CPC ..... *E02D 29/02* (2013.01); *E02D 29/0225* (2013.01); *E02D 3/046* (2013.01); *E02D 7/26* (2013.01); *E02D 15/04* (2013.01); *E02D 2600/20* (2013.01)

(56) References Cited

U.S. PATENT DOCUMENTS

| | | | | | |
|---|---|---|---|---|---|
| 4,607,981 | A * | 8/1986 | van Klinken | E02D 19/18 | 405/129.8 |
| 4,664,560 | A * | 5/1987 | Cortlever | E02D 5/14 | 405/109 |
| 5,106,233 | A * | 4/1992 | Breaux | B09B 1/008 | 405/129.8 |
| 5,259,705 | A * | 11/1993 | Breaux | B09B 1/008 | 405/129.8 |
| 5,354,149 | A * | 10/1994 | Breaux | B09B 1/008 | 405/129.6 |
| 5,800,096 | A * | 9/1998 | Barrow | B09C 1/00 | 405/249 |
| 6,427,402 | B1 * | 8/2002 | White | E02D 5/08 | 405/241 |
| 2010/0054859 | A1 * | 3/2010 | He | E02D 5/14 | 405/36 |

* cited by examiner

C—C

J—J

D-D

END POINT CLOSING WALL FORMING DEVICE OF EXTRUSION TYPE UNDERGROUND DIAPHRAGM WALL AND METHOD FOR OPERATING SAME

FIELD OF INVENTION

The invention relates to press-in type underground continuous wall closure device and method of use, belongs to the static press-in technical field for underground space development.

TECHNICAL BACKGROUND

Currently, in the construction of press-in type underground continuous wall (hereinafter referred to as the underground continuous wall) around the world, docking/connection between unit wall sections typically relies on mechanical socket devices to hingedly connect them one by one. At the end of construction when encircling the continuous wall, a new concrete wall unit connects with an already solidified and hardened old concrete wall unit. The mechanical sockets on the short sides of the hardened old concrete wall unit are unlikely to connect precisely with the other mechanical sockets to form a strong, continuous water-proof encircling points. The existing methods use overlapping walls on both inside and outside of the encircling seam to seal the connection to achieve waterproof and impermeability. In reality, the overlapping methods cannot achieve effective waterproof results, but also the overlapping structure is weak because it is not an integral part of the overall structure. This approach cannot meet the technical requirements for waterproof, soil retention, and weight bearing. Therefore, solving the technical problem of underground continuous wall closing without a gap is essential to ensure that the underground continuous wall will not lose its function of soil retention, water blocking, permeability resistance, and weight bearing.

SUMMARY OF THE INVENTION

An object of the invention is to provide an underground continuous wall closure device and method of use. By adding a separation device, which can be used separate the separation tracks, wings, and shields from the main body if necessary, embodiments of the invention first create conditions for closing the mechanical sockets between wall-forming devices at the underground continuous wall ends, thereby achieving no gap connection at the new and old concrete wall sections.

Embodiments of the present invention can be accomplished with the following implementations: a press-in underground continuous wall forming device for end closing comprises a main body, a vibration water-spraying device, and a separation device. The vibration water-spraying device is fixed within the main body, and separation device is movably disposed on the short side of the main body.

The main body includes an inner chamber, an outer wall body, a small outer wall, and a double valve. The inner chamber is a hollow rectangular cavity. Two pieces of cross section for the font of "7", two long side along the inner cavity of vertical discontinuous set, two short "7" head in the inner chamber wall relatively constitute the center of concave dovetail slot called outer wall; Concave dovetail slot and the adjacent automatic into wall socket device convex dovetail orbit phase; Outside wall in the lower section of the seam position the lumen deed, outside wall and reinforcing plate form cross docking deed mouth each length is longer than the countersunk head bolt; Qi mouth side set the seal slot; "7" word short head relative to the other side wall fixed two stone in the center a vertical pass long small concave dovetail slot of the outer wall, along the fixed, the short side of the lateral wall of the small concave cavity dovetail slot center vertical interval has the upper slope bottom is flat surface convex shoulder; The bottom of the system have the body of the double disc valve called basic; At the bottom of the dock with the basic period of vertical is not set up the body of the double disc valve generally referred to as the auxiliary section, double facade for the triangular flap valve, along the long side of inner chamber center is divided into two, each disc to the shorter edges bottom inner cavity place Settings are the axis pin hole, and lumen short side on the bottom of the set of axis pin hole misalignment embedded concentric shaft hole, articulated shape are formed by colluded shaft pin shaft hole; Basic period of bottom valve can be made into flat type valve, also by two pieces of flat plate type valve straight board relatively closed in the center of the cavity length edge, flat straight corresponding to the shorter edges on the bottom of the inner wall is set up with shaft pin holes, and short side on the bottom of the shaft pin hole misalignment embedded concentric shaft hole, its articulated method with double disc valve, there was a piece of flat straight seams along the closed center is tong long welding with sealed beam, seal on both ends of the beam overlap in the bottom of the short side, accordingly an increase of closed crack sealing and the compression strength; Set in the lower end of the inner cavity of magnetic devices.

What is important to be note is that the shape of inner cavity is varied, and it can also be set as round or oval shape, etc. if the inner cavity be set as round or oval shape, the inner side of the outer wall need to be made with corresponding curve, but still for the rectangular shape.

Separation device including separation orbit, latch strike and plane protecting wing, the section of the separation orbit is double male dovetail, the male dovetail which muff coupling with automatic device into a wall female dovetail slot is called big dovetail, and muff coupling with the little female dovetail of the little outer wall to be called little dovetail; Inserting the little dovetail to the little female dovetail from the top of main body will form the separation orbit which is full set along the vertical short side of inner cavity; And flat shape wings are set on both sides of the narrow place where the big dovetail and small dovetail intersects, wings are set on the outside of the little outer wall by plastic rivet, L-shape folded-wing is set on the both sides of the wings, completely covering the small vertical cracks of the little outer wall body and wings; Protecting shells are set at the bottom of the separate orbit and little outer wall and fixed by the plastic rivet; Latch strike and strike chamber are set at the location of the Convex shoulder corresponding to the vertical inside of the separation orbit, the bottom of the latch strike is bevel, and the upper is flat, the whole is the door latch lock tongue shape, the diameter. of back part is bigger than bore diameter of the latch strike hole, one side of the support spring is set in the spring seat of back part, the other side is set in the guide shaft spring seat corresponding to the inner wall of strike chamber, the bottom bevel of latch strike is correspond to the top bevel of strike chamber.

Vibration water device described consist inlet pipe, outlet pipe, circulating water pipe, cable pipe, air pipe, cooling water pipe, electric vibrator or air vibrator, vibrating chamber, spray valve, all kinds of line are fully set along the long side of inner chamber of the outer wall from the top of the body; Every side sets one inlet pipe and one outlet pipe, but the cooling water pipes are set on the basis of the number of electric vibrator and spray valve, if use air vibrator, the cable pipe equipped with electric vibrator should be changed into air pipe to be used for air vibrator, and now, the cooling water pipe become the special use for spray valve. In the inner side of the outer wall dome arch is set to adapt to the traffic; The spray valve is set on the vibration wall, outlet hole of the spray valve is set towards to the outside of the vibration wall, spray valve connected with cooling water pipe, and the ball valve is set in the outlet hole, usually, the pressure limiting spring will always resist drainage holes by ball value, circulating water can't flow out, if close outlet pipe valve, circulating water pressure will increase immediately and over the pressure of pressure limiting spring, ball value will be open, then water will flow out and wet the soil around the body and reduce its intensity, At this point if start the vibrator, under the influence of exciting force, amplitude, and infiltration, the difficulties of subject into or out will be solved.

The lower vibration of basic segment and secondary segment of the upper vibration will all add circulating water pipe cascaded with cooling water pipe, cooling water be pressed by water pump and flow into lower circulating water pipe from top to bottom and enter the first cooling water pipe, then flow down to the third cooling water pipe through circulating water pipe . . . . At the effect of water pump eventually flow into the static pile on the tank circling like this, and after cooled it will be pressed into inlet pipe by water pump and start a new circle.

Vertical of vibration wall fixed on concave shoulder of Two up and down outer wall by flush bolt and lateral be fixed on vibrating frame and form vibrating chamber; Electric vibrator or air vibrator are set on the inner side of vibration wall; The inlet pipe and outlet pipe connection static pile on the tank.

One of the usages of closing into a wall at the end of dispirited underground continual wall includes following technical procedures.

Technical procedure one: assembling. According to designed depth and thickness of underground continual wall to select basic segment and auxiliary segment in suitable type, docking them in order on the ground. The vertical total length could reach the designed elevation and construction technology conditions by increasing or decreasing auxiliary segment of different length. When upper and lower section connect, we need to make the upper and lower section butt-lap joint combine accurately to avoid water permeating, besides, we should also make sure the screwed hole set up on the outer wall aligned. The outer wall severs as flange at the same time. Tightening the bolts will make the docking quite firm. Protecting shell was set up at the separated track and the end of the small outer wall by plastic rivet, making the gap between them closed to avoid muddy impurity causing obstruction.

Technical procedure two: unidirectional movement application. When the fixed main body can not shift, make the little dovetail of the separate track insert into little female dovetail slot from the top of the main body to assemble. Now, little dovetail can only one-way move from top to bottom, and then make the latch strike and the boss touch, the lower slope of the latch strike continues to crawl along the upper slope of the boss touch, which lies in the center of little female dovetail fixed on the inner wall's short side of the inner chamber, thus forcing latch strike to transform the energy of vertical movement into kinetic energy by which the back part of latch strike presses support spring to make horizontal displacement along guide axis. Therefore, the latch strike was pressed into strike chamber little dovetail reach the designed position at the bottom of basic segment through the boss. When the separate equipment can't move due to the bond of concrete, the main body needs to lift out to form the monomer unidirectional movement from top to bottom. The upper slope of the boss touch the lower slope of the latch strike, due to the cant mechanics principle mentioned above, the latch strike was pressed into strike chamber, making the boss pass the latch strike smoothly, the main body can move upwards till pulling out the ground. When main body and the separate equipment need to squeeze into the underground that is to form catamaran unidirectional movement from top to bottom. At this moment, the lower flat surface of the boss which is fixed at the center of little female dovetail on the side wall of short side touches the upper flat surface of the latch strike set in the inner chamber of the separate track, losing the condition of slope movement, because of the restriction caused by little female dovetail, causing the separate track little dovetail can only move vertically rather than lateral movement or independence movement out of the little female dovetail. Unless the top surface suffers shear failure, otherwise, the lower flat face of the boss drives the upper flat face latch strike flat face and hence the overall separation device can only downward synchronously until the underground designed position without moving relative to one another or being separated.

Technical procedure three: closed ending separation; First, pressing the wall closure device into the underground along the axis of the underground continuous wall, and pause, then set the first diaphragm wall forming equipment—female dovetail into the wall closure device—separate device big dovetail and squeeze it into underground, filling with concrete timely, then the static piling machine further along the axis of the underground continuous wall. Then set the second diaphragm wall forming equipment—female dovetail into the first diaphragm wall forming equipment—male dovetail and squeeze it into underground, filling with concrete timely, raising the first diaphragm wall forming equipment slowly, double disc valve open under gravity. due to the unidirectional movement principle, the concrete in the inner chamber outflow quickly, filling the space given away by the upward main body and form the first section of the underground cell wall section, the condition of separate device following diaphragm wall forming equipment is not set up, still adhere to the wall closure device, however, the concrete out of the wall closure device adhere to the outer edge of the separate track and the wings to produce sticky force after solidification. When the underground continual wall construction reach the end of the camp press the last diaphragm wall forming equipment—male dovetail slot into the back of the wall closure device—female dovetail slot, and squeeze it into the same depth underground, thus, complete the mechanical closed connection at the end of camp of underground continual wall. Pouring the concrete into the first wall closure device and the last diaphragm wall forming equipment, starting electric vibrator or air vibrator to Gradually improve the wall closure device, since the earliest perfusion concrete has hardened and stuck the separation devices that are close to the concrete, she sticky force is greater than the sum that supporting the spring tension plus plane protecting wing plastic rivet pull and the resistance between the little female dovetail slot and the little dovetail, to satisfy the subject upward monomer one-way movement condition, pull up the first into wall closure device, the separate orbit and protecting shell is left in the new form of underground continuous concrete wall Then the last diaphragm wall forming equipment will be vibrated while ascended, because of concrete that in the before and after socket part of the device does not produce big sticky force, the last diaphragm wall forming equipment will be pulled out; expiration orbit, plane protecting wing and L-shape folded-wing that in the concrete wall from the structure of the good permeability.

Beneficial effects of the present invention is:

The invention have separation devices, using one-way movement, creating the closed condition of the mechanical connection that in the diaphragm wall forming equipment firstly, then separating the separation track, plane protecting wing and protecting shell in underground continuous concrete wall, forming the link of old and new concrete wall without gap that in the finish of The underground continuous wall, To ensure the continuity and function of the underground continuous wall molding, new approaches of technology, the wall quality is reliable, saving resources.

In Figure: 1 main body; 2 inner chamber; 3 outer wall; 3' litter outer wall; 3" long outer wall; 4 double door valve; 4' side plate of valve; 5 separation track; 6 boss; 7 female dovetail; $7^{-1}$ T-shape slot; $7^{-2}$ circle slot; $7^{-3}$ diamond slot; $7^{-4}$ bevel-slot; $7^{-5}$ elliptical slot; 7' male dovetail; 8 butt-lap joint; 8' seal slot; 9 strengthen plate; 10 basic segment; 10' auxiliary segment; 11 short side; 11' short side; 12 long side; 12' long side; 13 axle pin hole; 13' axle pin hole; 14 axle pin; 15 magnetic part; 16 plate valve; 16' sealing beam; 17 little female dovetail slot; 18 latch strike; 19 plane protecting wing; 19' L-shape folded-wing; 20 female dovetail slot; 21 big dovetail; 21' little dovetail; 22 plastic rivet; 23 back part; 23' latch strike hole; 24 strike chamber; 24' inner wall; 25 support spring; 26 spring seat; 27 guide axis; 28 inlet pipe; 28' outlet pipe; 29 circulating water pipe; 30 cable pipe; 31 air pipe; 31' cooling water pipe; 32 electric vibrator; 32' air vibrator; 32" Ω clip; 33 vibrating chamber; 34 spray valve; 35 screw bolt; 35' shen head bolt; 35" threaded hole; 36 vibrating wall; 37 water hole; 38 ball valve; 39 pressure limiting spring; 40 concave shoulder; 41 frame; 42 dome arch; 43 flange; 44 protecting shell; 45 wall closure device; 46 diaphragm wall forming equipment; 46' second diaphragm wall forming equipment; 46" the last diaphragm wall forming equipment.

DETAILED DESCRIPTION

Embodiments of the invention will be further illustrated with the aid of the attached drawings.

EXAMPLE 1

Figure 1:
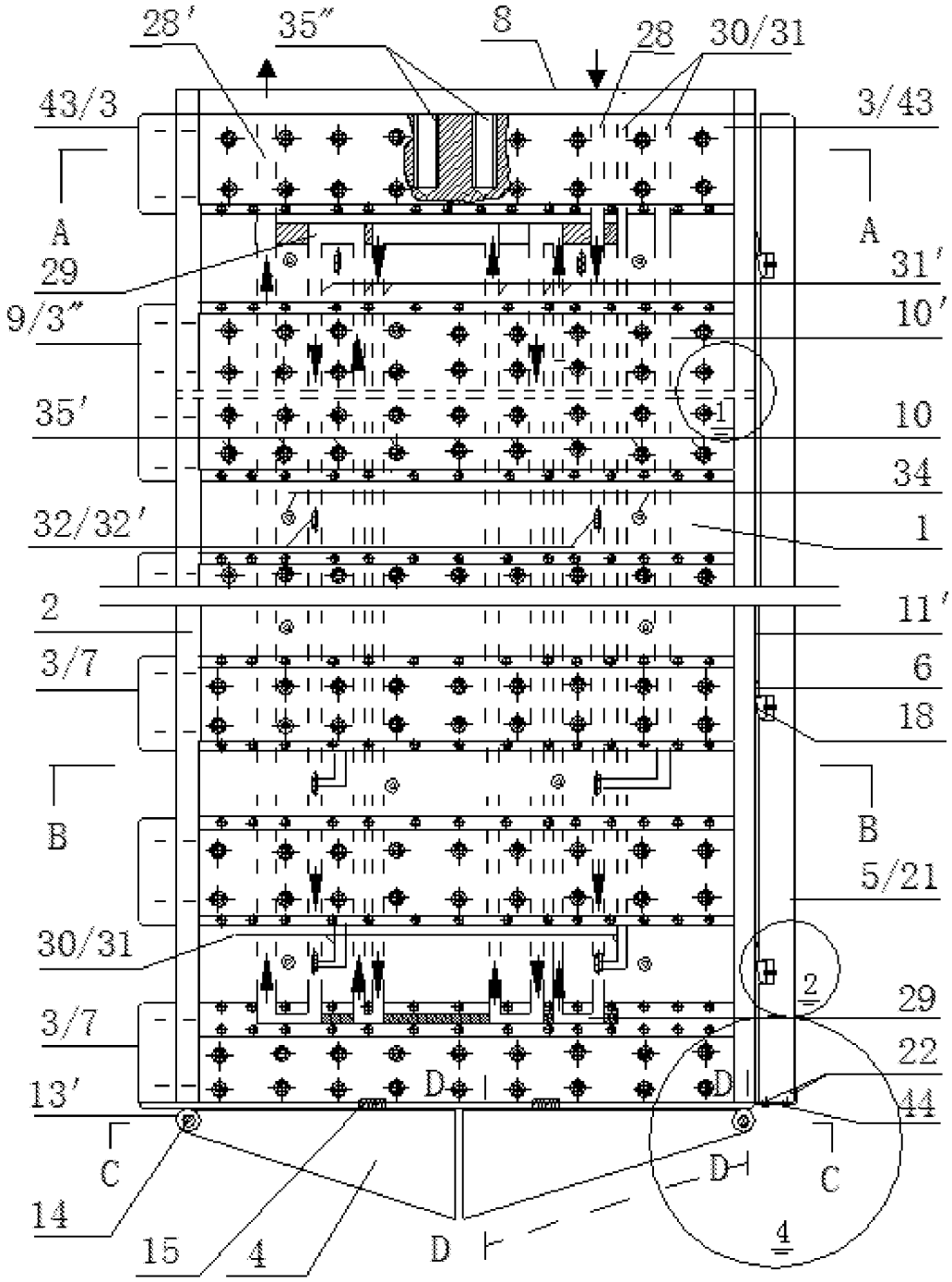
FIG. 1 Front view of ECESD.

As shown in FIG. 1, which is an elevation view of a wall closure device, a device of the invention includes a main body 1, a separation device, and a vibration water-spray device. The vibration water-spray device is set within the main body 1 and is fixed with the main body 1. A device of the invention also includes a separation device, which is disposed on the outside of the main body 1 and is moveably attached to the main body 1.

Figure 2:
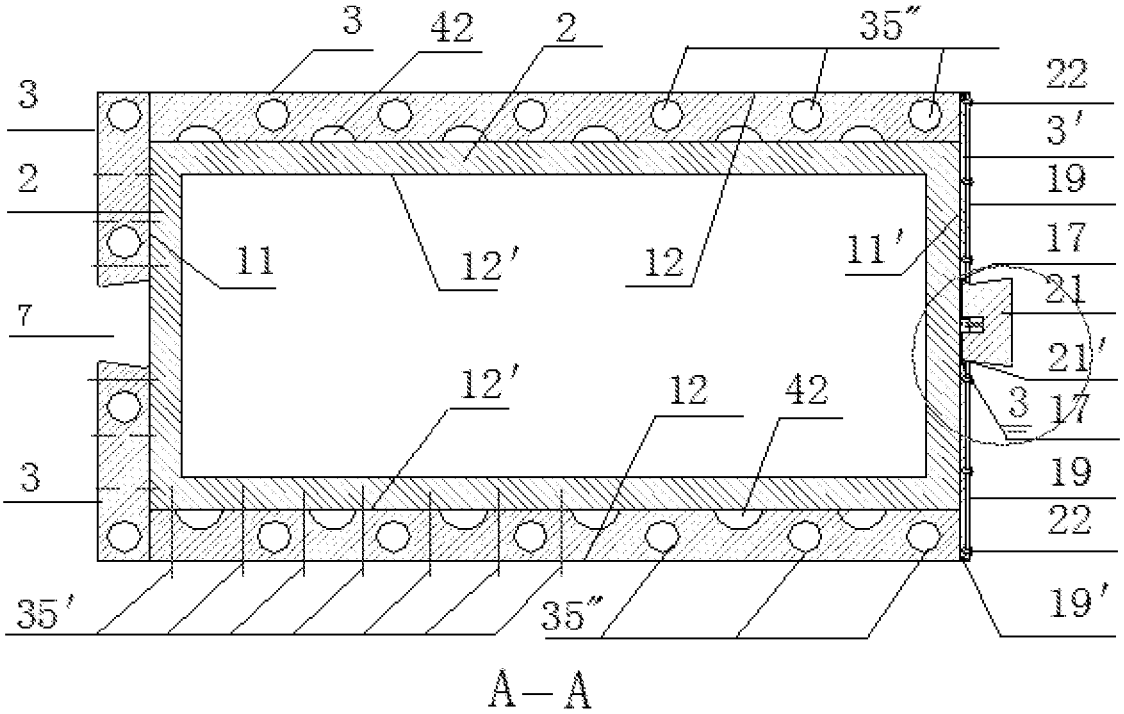
FIG. 2 A-A section view of FIG. 1.
Figure 3:
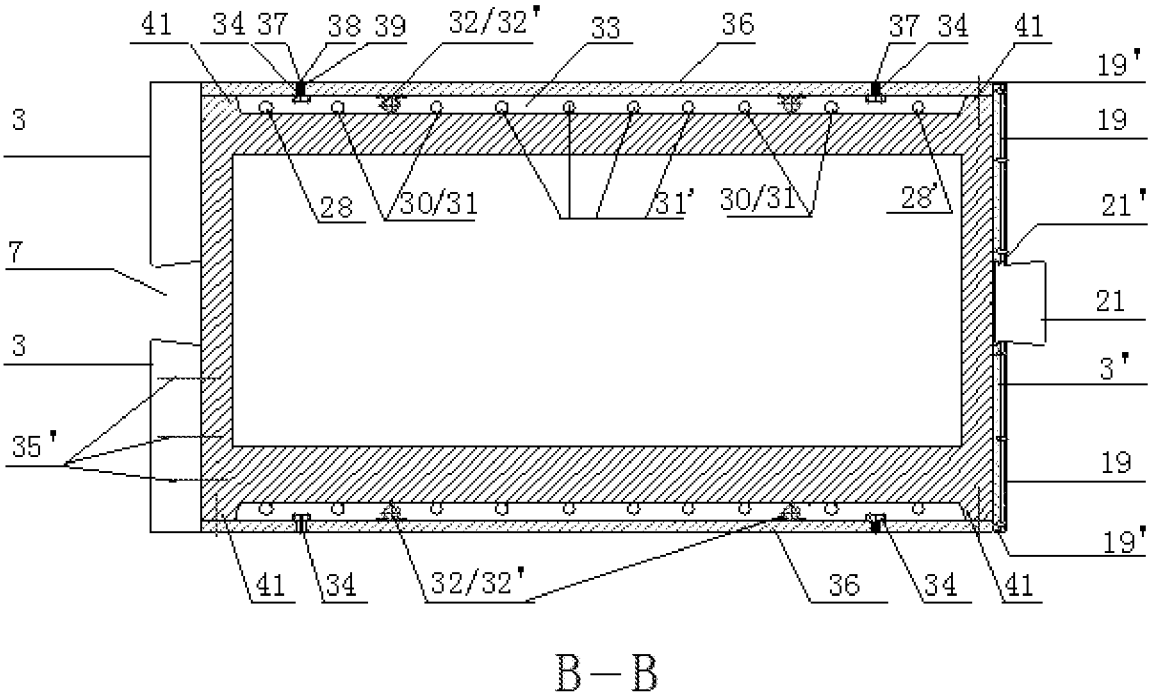
FIG. 3 B-B section view of FIG. 1.
Figure 4:
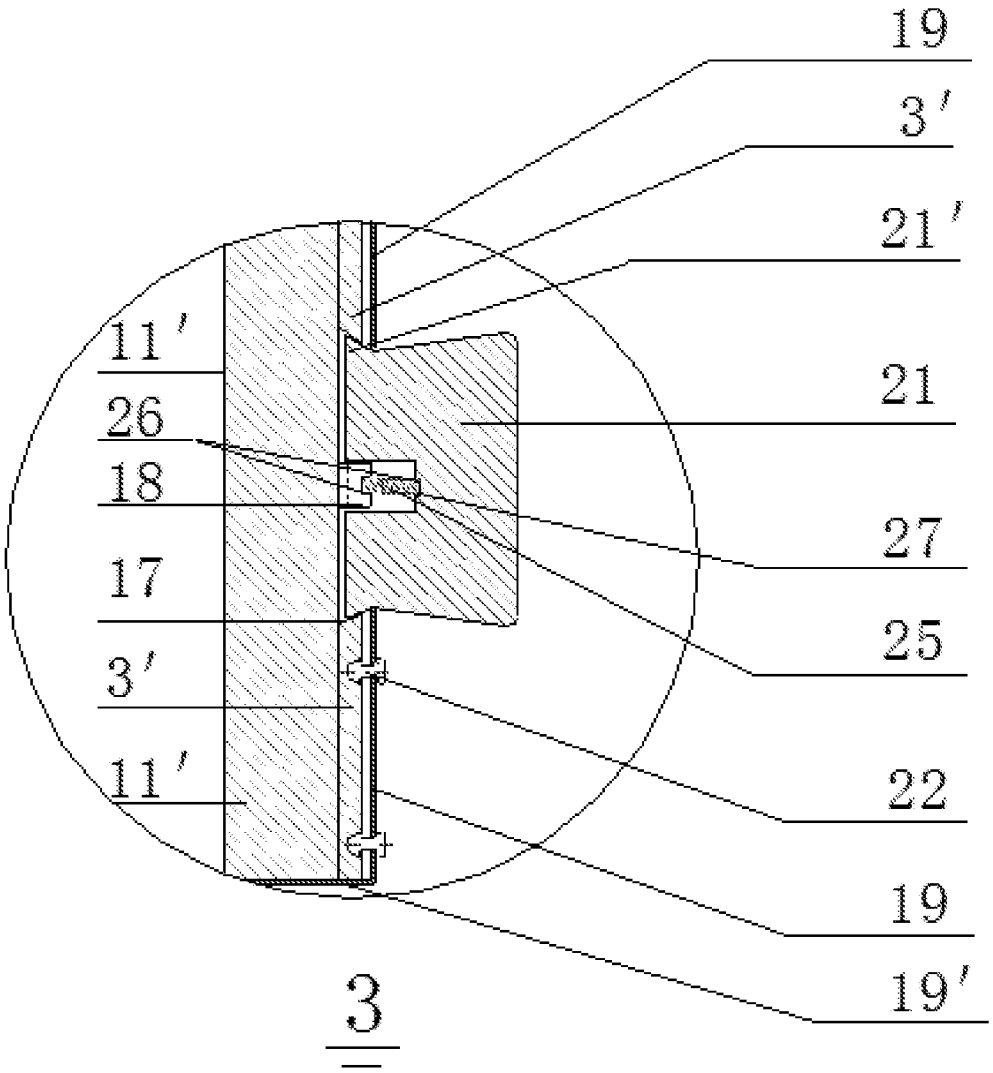
FIG. 4 Large drawings of detached device and folded wings.

As shown in FIGS. 2, 3, and 4, the main body 1 of a device of the invention includes an inner chamber 2, an outer wall body 3, a small outer wall 3', and a double valve 4. The inner chamber 2 may be a rectangular body with a hollow cavity, having the following dimensions: the long side 12' has an inner dimension of 300-1100 mm and an outside dimension of 400-1200 mm; the short side 11 and 11' have an inner dimension of 200-1000 mm and an outer dimension of 300-1100 mm. Along the short side 11' of the inner chamber 2 there is a dovetail-shaped trough 17, the center of which is provided with a protrusion shoulder 6 at regular intervals. The protrusion shoulder 6 has a slant top and a flat bottom.

It should be noted that the shape of the inner chamber 2 can be varied. For example, the inner chamber 2 may be round or oval shaped, etc. If the inner chamber 2 has a round profile, then the inner side of the outer wall 3 shall have a corresponding arc shape to match the outer profile of the inner chamber 2, but outside profile of the outer wall 3 can still be a rectangular shape.

As shown in FIG. 2 and FIG. 3, the outer wall 3 cross section comprises two "7-shaped" (or "L-shaped") pieces placed along the long sides 12' of the inner chamber 2. The two "L" head (short branch of the "L") are disposed on the short side 11 of the inner chamber 2 to form a dovetail-shaped trough 7. The dovetail trough 7 will mate with the dovetail-shaped protrusion track 7' on a neighboring automatic wall-forming device 46. After mating of the dovetail trough 7 and dovetail track 7', the automatic wall-forming device 46 and the wall-forming closure device 45 can only slide along the track and cannot separate from each other or move in radial direction. Two outer wall body 3' are fixed, using bolts 35' or welding, on the short side 11' of the inner chamber 2 such that they form a dovetail-shaped trough at the center of the short side 11'. As shown in FIG. 1, near the joint 8 between the upper and lower inner chamber 2, the outer wall body 3" is larger and a reinforcement plate 9 is added. Specifically, the outer wall body 3" is increased in size such that it spans the joint 8, half above and half below, at the two sections of the inner chambers 2. The outer wall body 3" is fixed with bolts 35' to achieve connection and enforcement functions.

Figure 14:
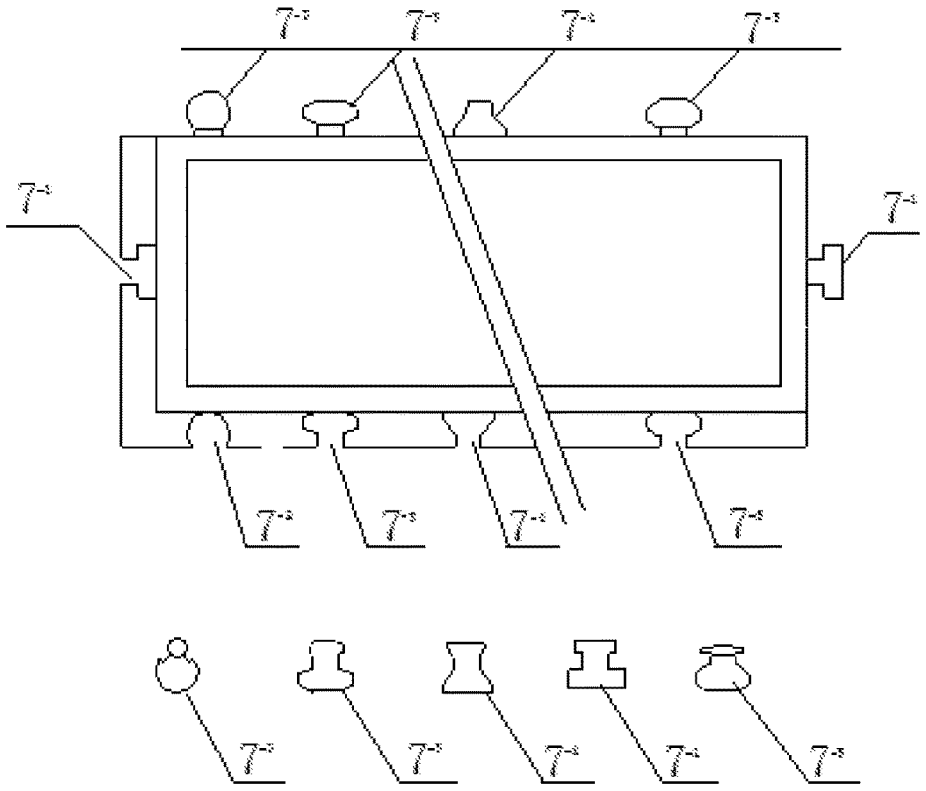
FIG. 14 Sketch of multiple socket shapes.

Similarly, as shown in FIG. 14, the above-described dovetail-shaped trough 7 can adopt other shapes: a "T" shape trough 7-1, round trough 7-2, diamond trough 7-3, hypotenuse (slant slope) trough 7-4, oval trough 7-5. The matching dovetail-shaped track 7' can correspondingly adopt various shapes. For example, if "T" shaped trough 7-1 is used, the two adjacent wall-forming devices 46 can only have linear axial (in the plane of the continuous wall) movement, whereas when a round trough 7-2 is used, adjacent wall-forming devices 46 not only can move in the axial direction, but also swing in an arc motion within a certain range.

EXAMPLE 2

Figure 8:
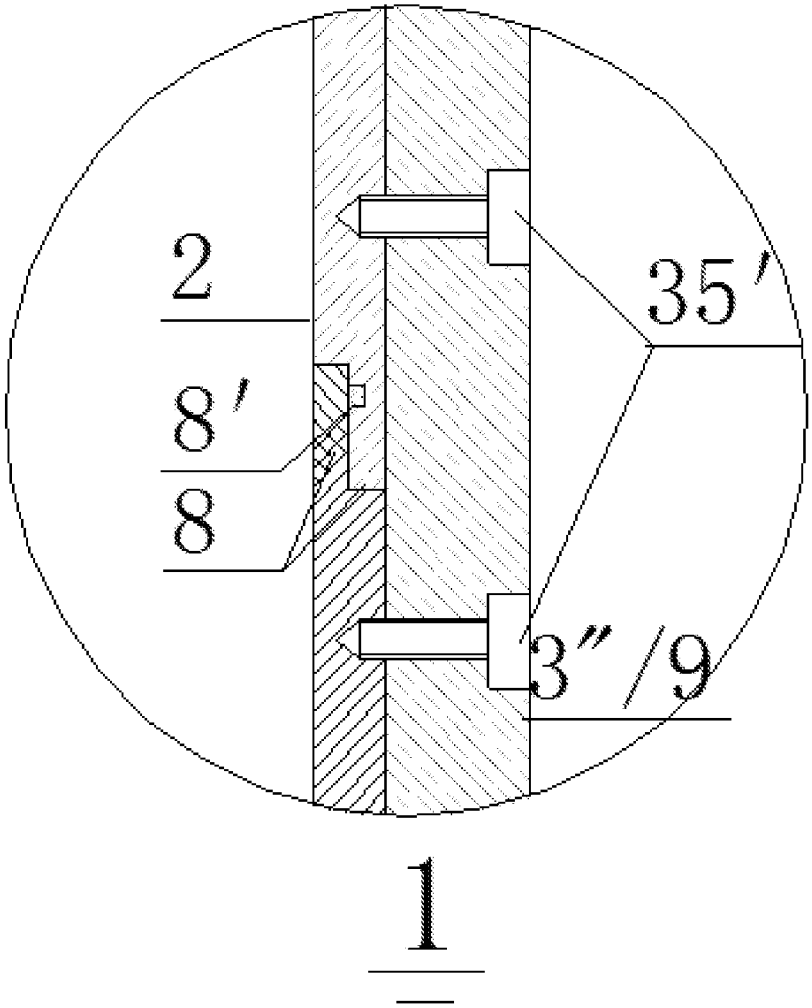
FIG. 8 Large drawing of joint in FIG. 1.

As shown in FIG. 8, on one side of the joint 8, there is a sealing trough (groove) 8' to facilitate tight-seal installation to prevent leakage.

As shown in FIG. 1, the bottom section of the main body 1 with a double valve 4 is referred to as a base section 10. The lengths of the base section 10 is ≤50 m. The bottom section of the main body 1 without a double valve 4 is referred to as an auxiliary section 10'. The lengths of the auxiliary sections 10' range between 1500 mm and 15000 mm. The lengths of the short sides 11, 11' of the main body 1 correspond to the thickness of the underground continuous wall and are designed to meet the protection structure strength and waterproof requirements. Their lengths may be in the range from 300 mm to 1300 mm.

EXAMPLE 3

Figure 6:
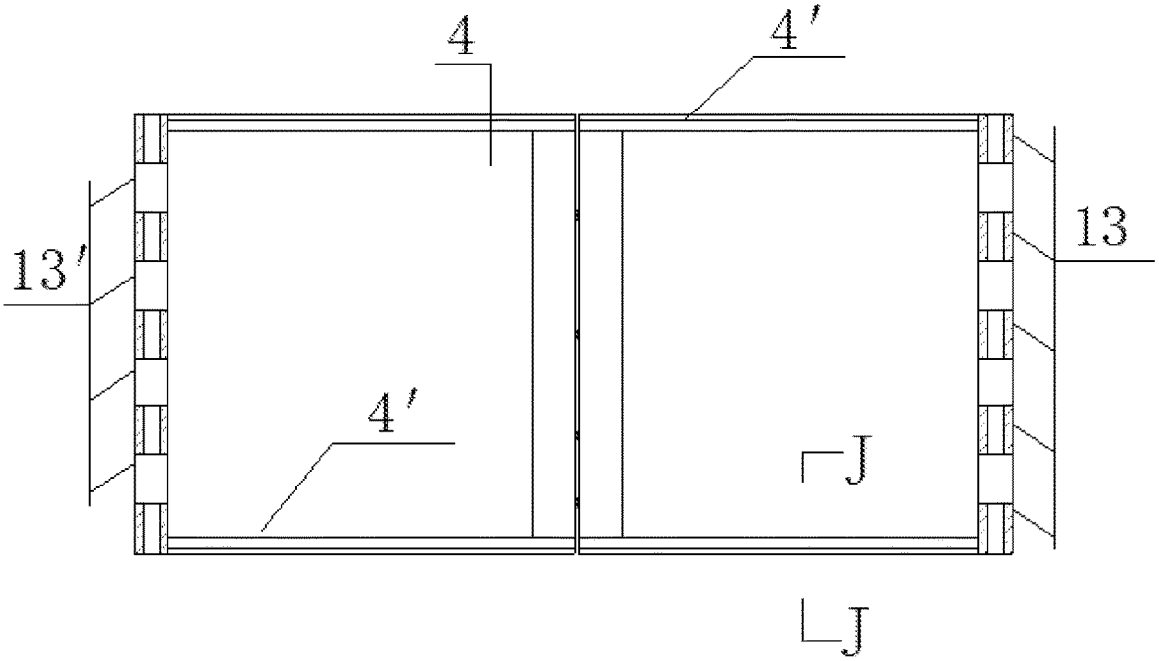
FIG. 6 C-C cutaway view of double door valve.
Figure 7:
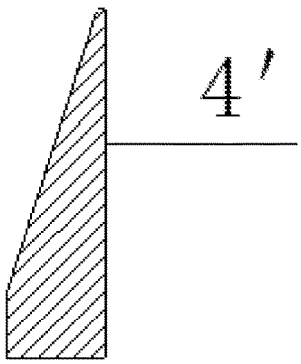
FIG. 7 J-J cutaway view of side plate of double door valve.
Figure 9:
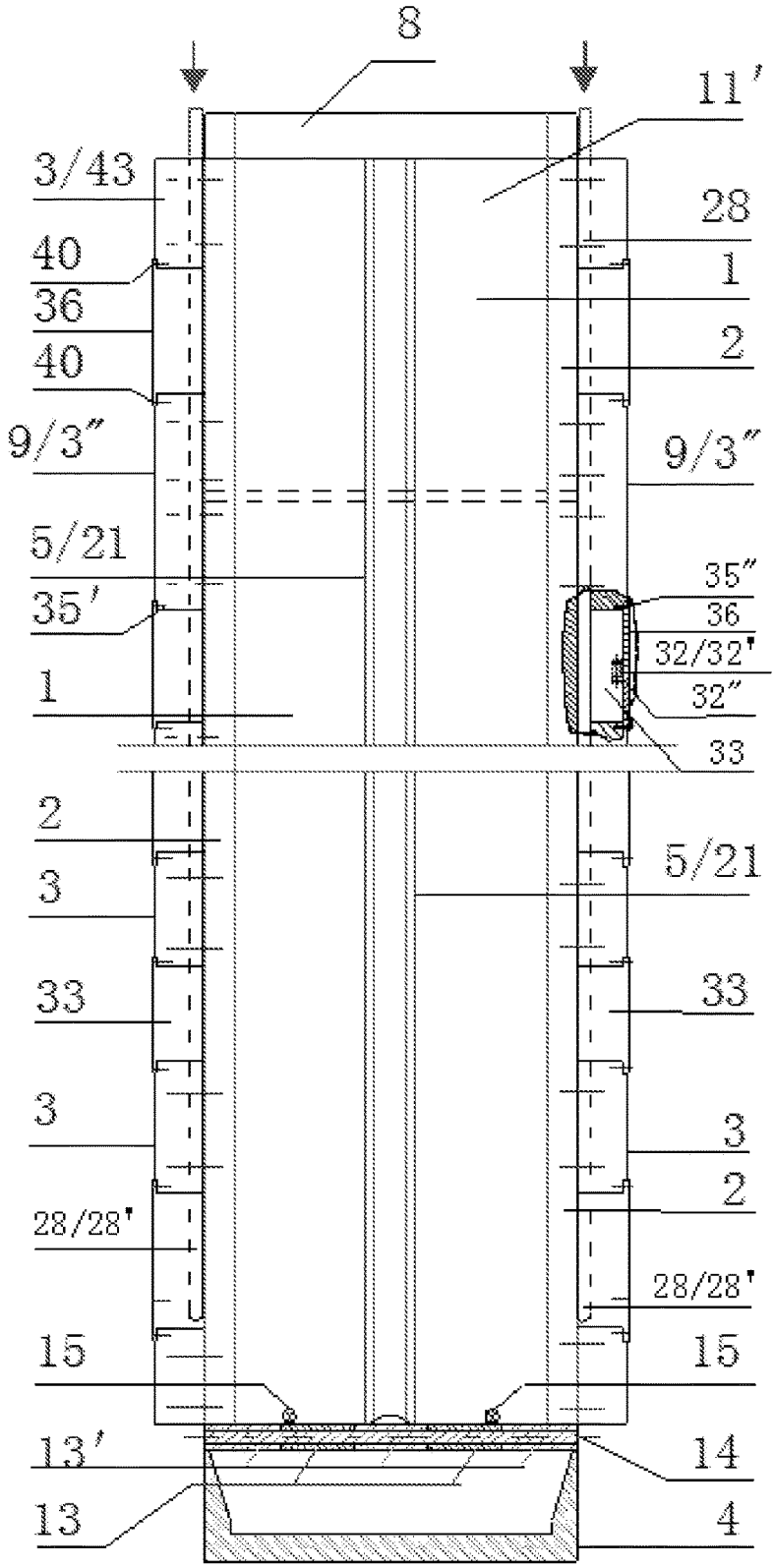
FIG. 9 Right view of FIG. 1 and D-D cutaway view of valve.
Figure 10:
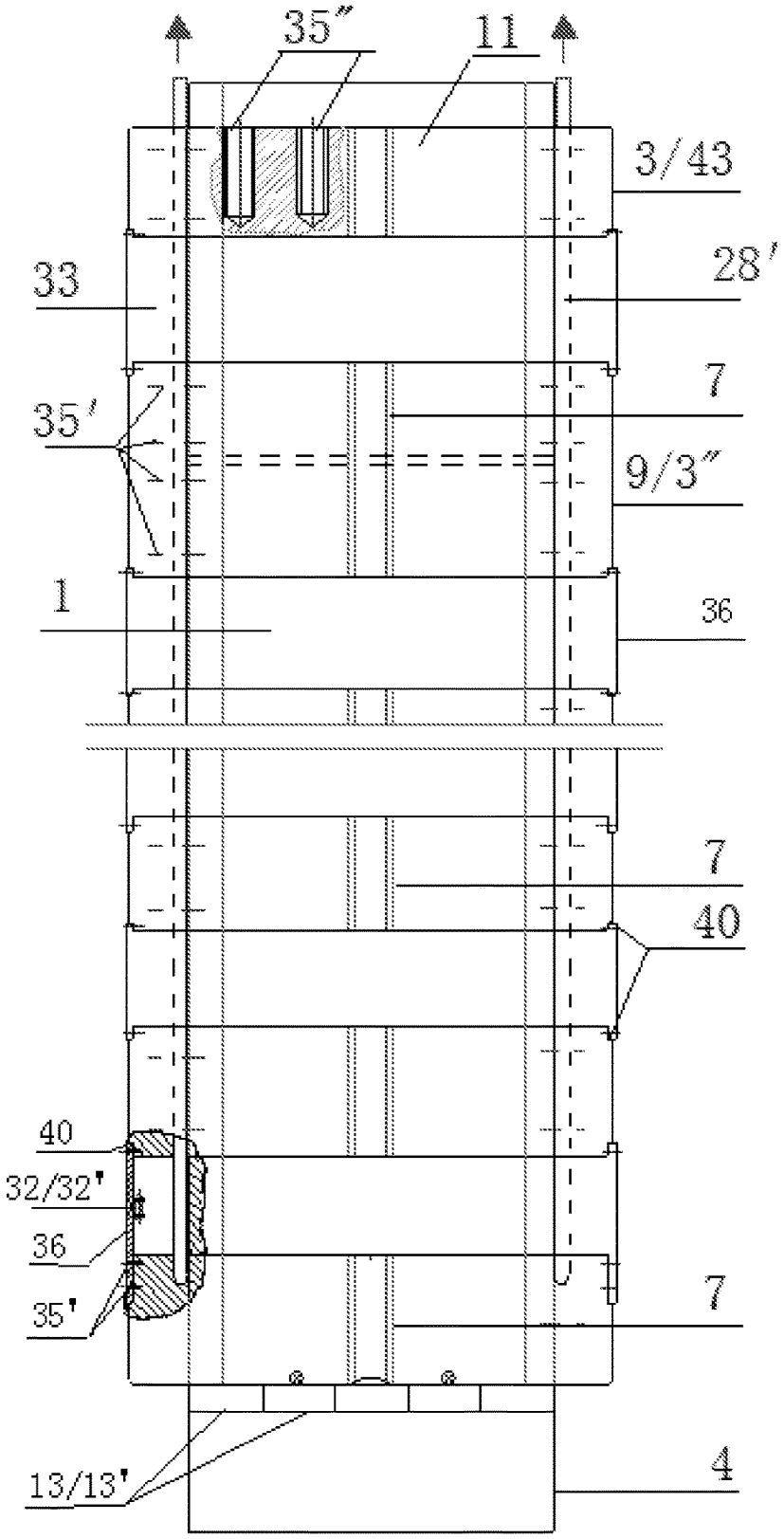
FIG. 10 Left view of FIG. 1.
Figure 12:
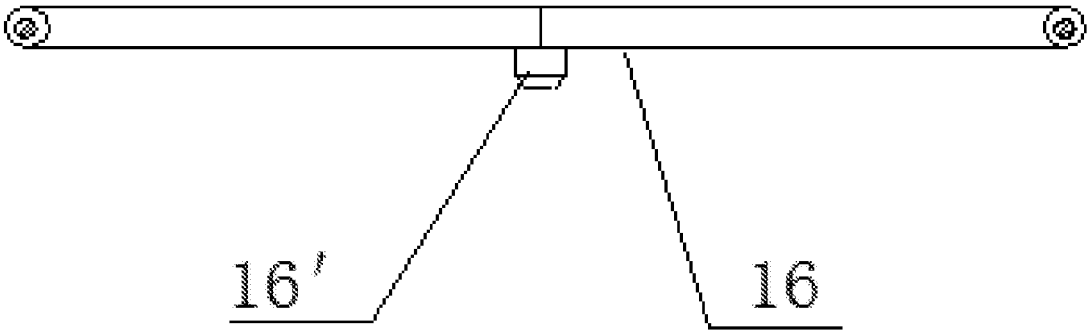
FIG. 12 Sketch of plate valve at the bottom.
Figure 13:
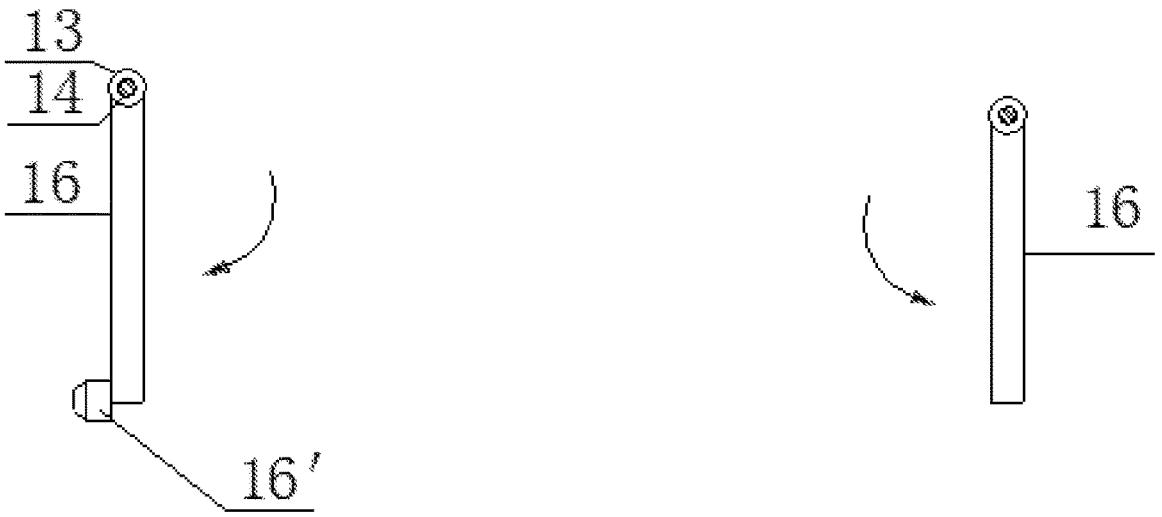
FIG. 13 Sketch of open of FIG. 12.

As shown in FIG. 1, FIG. 6, FIG. 7, and FIG. 9, the front side view of the double valve 4 is a triangle, with a valve side panel 4' that has a vertical side aligned with the inner cavity 2 vertical sidewall and a blade-shaped (sharpened on one side) top. Along the center of the long sides 12' of the inner cavity 2, the double valve is divided into two valves. As shown in FIG. 6 and FIG. 9, each valve has at least two shaft pin holes at the joint with the short sides 11, 11' of the inner chamber 2. The bottom of the short sides 11, 11' of the inner chamber 2 also has at least two shaft pinholes 13' offset from the pinholes 13 such that they can forma concentric shaft hole, through which a shaft pin 14 is inserted to achieve hinged connection. As shown in FIG. 12 and FIG. 13, the double valve 4 can also adopt other shapes, such as a plate valve 16. The valve plate valve 16 is formed with two pieces of a certain thickness of flat plate that close and meet at the center of the long side 12'. The flat plates have shaft pin holes 13 along the short sides 11, 11' of the inner chamber 2. These shaft pinholes 13 corresponds to, but offset, the shaft pin holes at the bottom of the short sides such that they can form a shaft hole. The are hingedly connected as for the double valve 4. One of the flat plate has, at the center closure edge, a seal beam 16' welded thereon. The two ends of seal beam 16' can rest on the bottom of the short sides. The seal beam 16' protrudes beyond the edge such that it will flap over the other piece of flat valve when closed, resulting in enhanced sealing and strength. As shown in FIG. 12, when the inner chamber 2 is empty, two magnetic devices 15 disposed at the bottom of the inner chamber can magnetically close the plate valve 16 due to magnetic forces. When the plate valve 16 is squeezed into the ground in a closed state, it is further tighten by the counter force of soil compaction such that mud or impurities cannot enter the inner chamber 2. As shown in FIG. 13, when pulling up the main body 1, the counter forces from the soil acting on the plate valve 16 on the counter force quickly disappear. The weights of the contents (steel, concrete, or other mixtures) in the inner chamber 2 will overpower the forces of the magnetic devices 15. The plate valve 16 is pushed open by the weights, swinging open along the shaft pin 14 like a swing door. The two plate valves 16 will open to a vertical position to align with the short sides 11, 11' of the inner chamber 2. The contents of the inner chamber 2 will quickly flow out to fill the void in the soil left by the main body 1 that is being pulled up. The operation principles of the double valve 4 are the same as the plate valve 16.

EXAMPLE 4

Figure 5:
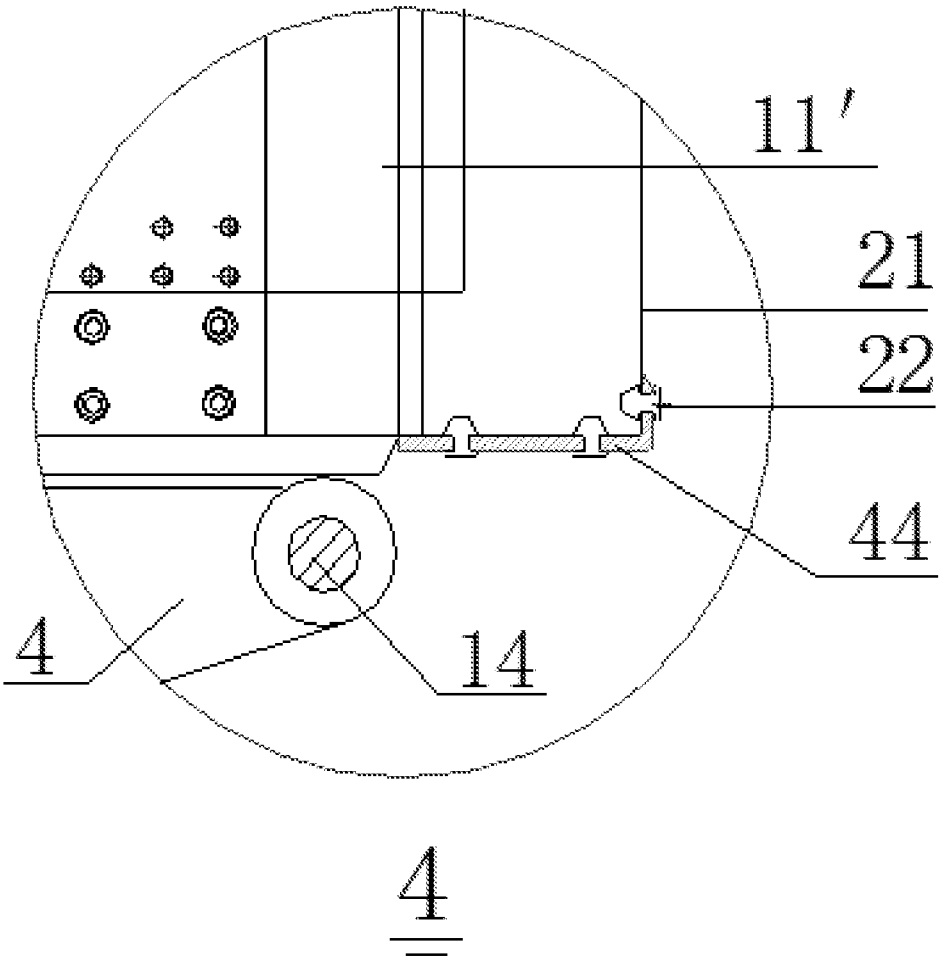
FIG. 5 Large drawing of protecting shell.
Figure 15:
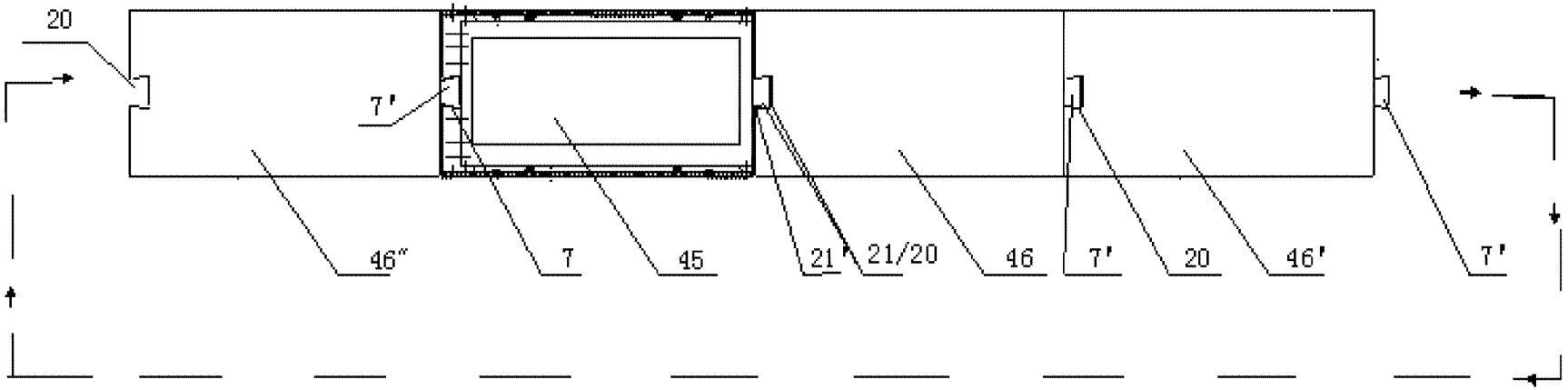
FIG. 15 Schematic of using steps.

The separation device includes a separation track 5, ratchet 18 and wings 19. As shown in FIG. 2, FIG. 3, and FIG. 15, the protrusion dovetail-shaped track 21 that hingedly connects with the dovetail-shaped trough 20 on the automatic wall-forming device 46 is referred to as a large dovetail track, and the one 21' that connects with the small dovetail-shaped trough 17 is referred to as a small dovetail track. As shown in FIG. 1, the small dovetail track 21' inserts into the small dovetail trough 17, from the top of the main body 1 all the way to the bottom, forming a separation track 5 at the short side 11' of the inner chamber 2. As shown in FIG. 5, the "∟" shaped shield 44 is fixed, using plastic rivets 22, on the separation track 5 and the bottom of the dovetail trough 17 to seal the gap between the separation track 5 and the outer wall body 3' to prevent slush from entering the system to clog the system. As shown in FIG. 4, at the junction of the big dovetail 21 and small dovetail 21', there are provided flat wings 19 on both sides of the narrow part. The vertical length of the flat wings 19 is the same as the separation track 5, and the width of the flat wings 19 is the same as the thickness of the main body 1. The flat wings 19 are first installed on the separation track 5 and then are anchored on the small outer wall 3' using plastic rivets. The rivets should be sufficient to ensure that they do not fall off during press-in and would not impede the separation during pulling-up. As shown in FIG. 2, FIG. 3, and FIG. 4, "∟" foldable wings 19' are provided on both sides of the flat wings 19. The foldable wings 19' seal off the gaps between the small outer wall body 3' and the flat wings 19.

Figure 11:
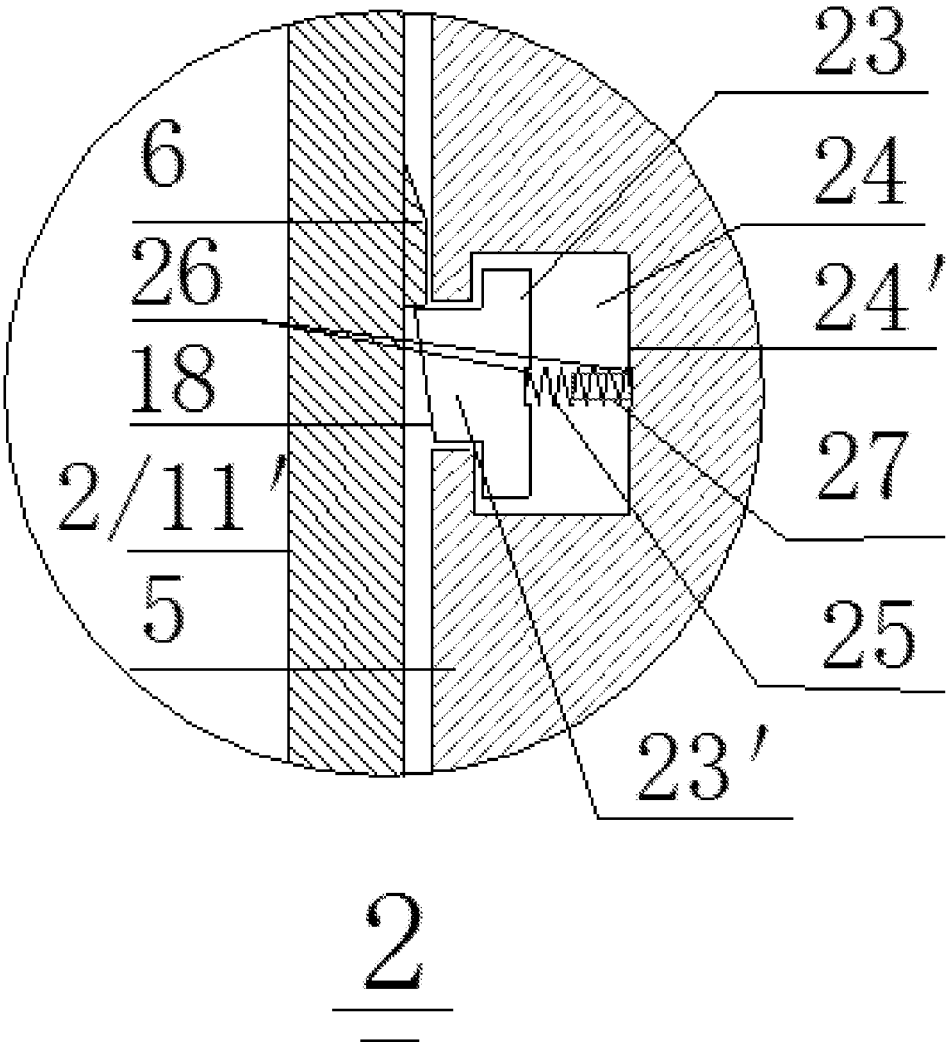
FIG. 11 Large drawing of the latch strike.

As shown in FIG. 11, latch strikes 18 and strike chamber 24 are installed at the inner side of separation track 5 at a location corresponding to the protruded shoulder 6. Latch strike 18 has a slope bottom and a flat upper part, like a door latch tongue. The diameter of the back shoulder 23 of latch strike 18 has a larger diameter than the diameter of latch strike hole 23'. One end of the support spring 25 is in the spring seat 26 of ratchet back shoulder 23 and the other end is in the ratchet chamber 24 at the spring seat 26, which includes a spring guide post 27. In the absence of an external force, support spring 25 pushes the ratchet spring 18 out of the latch strike chamber 24 a short distance along the guide post 27. The sloped top of the latch strikes 18 coordinates with sloped side of the protruded shoulder 6 to convert a vertical movement into a horizontal displacement to control the extension or retraction of the latch strikes 18. The above description is based on one-way movement. The following example 6 further explains this in detail.

It should be pointed out that, as shown in FIG. 14, the cross-section shape of the separation track 5 can also be in other shapes, according to the need, such as a double "T" shape, double circular, and double diamond, double slanted sides, and double ellipsoidal (oval) form. All these forms can achieve very good effects.

EXAMPLE 5

As shown in FIG. 1 and FIG. 3, a vibration water spraying device includes an inlet pipe 28, an outlet pipe 28', a water circulation pipe 29, an electric cable conduit 30, an air duct 31, a cooling water pipe 31', an electric vibrator 32 or air vibrator 32', a vibrating chamber 33, and a sprayer valve 34. All pipe lines run from the top of the main body 1 along the vertical direction of the outer wall of the long sides 12' of the inner cavity 2. As shown in FIG. 2 and FIG. 3, Outer wall 3 medial position Settings have to adapt to each line of dome arch 42, various pipe by the dome arch into the vibration within the warehouse 33, With "Ω" clip 32" fixed it outside the cavity wall by bolts 35. Various pipe butt choice in vibration warehouse 33 to finish. Vertical direction along the main body of the two long sides of a row of various pipelines, but feed line 28, 28' outlet pipe in each row only one root, Cable pipe 30, Air pipe 31, Cooling water pipe 31'. Based on the amount of electric vibrator 32, Air vibrator 32', vibrating chamber 33, spray valve 34 to set, If use air vibrator 32' to 30 tube into the cable duct 31, cooling water pipe 31' will be used exclusively for spray valve 34.

The water hole 37 of spray valve 34 toward the vibrating wall 36 is arranged on the outer side, the water spray valve 34 and the cooling water pipe 31' connectivity; water hole 37 is arranged in the ball valve 38, usually pressure limiting spring 39 will always 38 ball valves withstand water hole 37, water cannot flow out, when meets hard soil it is difficult to squeeze into, the valve of water outlet pipe is closed 28', pipe pressure quickly increased and when the pressure over the tension of limiting spring 39, 38 ball valves to be opened, and the water through the water hole 37 outflow main body 1 surrounding soil make the strength of soil decreased, start the electric vibrator 32 or air vibrator 32', the exciting force, amplitude and triple role of infiltration under, the main body 1 crowding in and pull difficult to be solved. Electric vibrator 32 work belongs to the heat element and need a large amount of cooling water, and air vibrator 32' does not require direct supply of electricity and without cooling water, as the preferred application. vibrating chamber 33 by 36 vibrating wall equipped on the two sections of the outer wall 3 concave shoulder 40, with countersunk screw bolt with 35 fixed, transverse mounted on vibration frame 41, the same with countersunk threaded hole with 35' is formed by fixing the corresponding space; electric vibrator (32) through "Omega" 32 cards air vibrator 32' by flange 43 were screw bolt with 35 installed at the inner side of the wall vibration 36. Start the electric vibrator 32 or gas source Vibrator 32', namely in vibrating wall 36 produced higher excitation force and amplitude, to main body 1 of the crowding in and pull out friction and increase the vibration of concrete compacting are of great help.

EXAMPLE 6

As shown in FIG. 15, a method of use of the present invention includes three process steps: assembly, unidirectional motion applications, and endpoint separation and closure.

Process step one, assembly: according to the design of underground continuous wall depth and thickness, select the appropriate model of the basic segment of 10 and auxiliary segment 10 which in turn on the ground, the vertical total length by increasing or decreasing the auxiliary segment 10' meet the design elevation and construction conditions is limited. On the connection, should pay attention to in addition to the upper and lower segment of contract 8 alignment into to prevent water seepage, but also should be arranged vertically on the outer wall 3 on the threaded hole 35" alignment, wall body at this time flange 43, with bolts tightened to a very stable docking. separation track 5 shows, the protecting shell 44 plastic rivet is arranged to separation track 5 and a litter outer wall 3' bottom end, separate track 5 and a litter outer wall 3' between the gap closed to prevent slurry impurity to squeeze into the obstruction.

Process step two, unidirectional motion applications: when the main body 1 does not produce displacement, the separation track 5 of the little dovetail 21' agent 1 top set into the little female dovetail slot 17 implement assembly: the big dovetail 21 only from down for a single one-way movement, and the latch strike and a convex shoulder touch. At this time, the latch strike is arranged at the lower part of the slope along the fixed in the inner cavity of the short side 11' side wall of the little female dovetail slot 17 of the center of a convex shoulder is arranged on the upper part of the slope creeping, to force the latch strike vertical movement of energy through slant mechanics principle of the latch strike hole 23' push ratchet latch strikes shoulder compression spring support along the guide axis 27 level 18 boss 6; 10 shift of basic segment, so, the latch strike 18 were forced to retreat into the strike chamber 24, little dovetail 21' through the boss 6 able to reach basic section at the bottom of the predetermined position when the separation device is concrete bonding does not produce displacement: main body 1 need to enhance the pullout formed from the bottom to the monomer unidirectional movement, convex shoulder at the upper part of the inclined plane and the lower inclined surface of the touch, due to the aforementioned bevel mechanics principle, the latch strike were forced to retreat into the strike chamber 24, the boss 6 smoothly through the latch strike, main body 1 continues upward until the pull out the ground; when the main body 1 and separating device and squeeze into the ground, both formed from down the catamaran unidirectional movement, which, fixed in the short side 11' side wall of the little female dovetail slot 17 in the center of the convex shoulder is arranged at the lower part of the flat face and the separation track 5 is arranged in the inner cavity of the installation of the latch strike 18 upper flat surface conflict, lost the slope movement conditions and due to the little female dovetail slot 17 of the separation track small dovetail 21' control. Make the little dovetail vertical 21' move up and down along the little female dovetail slot 17, the little dovetail vertical 21' only can make radial motion or independence movement out of the little female dovetail slot 17, unless the inconsistent surface of the little female dovetail slot 17 is shear failure, otherwise, The boss bottom flat face drive the latch strike 18 upper flat face and then drive the separation unit, the little dovetail vertical 21' can only be reached synchronization downward until the common underground without reservation position relative to one another or be separated.

Process step three, the last separation closed: first, Squeeze the wall closure device 45 into the underground along the axis of the underground continuous wall and pause; Then pull the female dovetail 7 of the first diaphragm wall forming equipment 46 into the big dovetail 21 of the wall closure device 45 and squeeze it into the ground, filled it with concrete in time, then the static piling machine move one step along the axis of the underground continuous wall line, pull the female dovetail 7 of the second diaphragm wall forming equipment 46' into the female dovetail 7 of the first diaphragm wall forming equipment 46 and squeeze it into the ground, filled it with concrete in time. Lift the first diaphragm wall forming equipment 46 slowly, Open The double door valve 4 under the gravity. The concrete of the inner chamber 2 flow out quickly, and fill the soil space on body 1 and form the first section of the underground cell wall. Due to the unidirectional movement principle, there won't be the condition that the separation track 5 move upward followed the diaphragm wall forming equipment 46. So the separation device is attached to the wall closure device 45 as before, but the diaphragm wall forming equipment 46 outflow concrete and the concrete adhesion on the outer edge of the separation track 5 and the plane protecting wing 19 promptly, Produce sticky force after solidification. When the project where the diaphragm wall is encircled is going to finish, Pull the T-shape slot of the last diaphragm wall forming 46" into the female dovetail 7 of the back end of the wall closure device 45 and squeeze it into underground in the same depth, that is, the mechanical seal between devices of the place that the diaphragm wall is encircled is finished; Fill the first wall closure device 45 and last only the last diaphragm wall forming equipment 46" with concrete, Then turn on the electric vibrator 32 or the air vibrator 32, turn up the wall closure device 45 gradually, Due to the earliest per-fusion concrete has hardened and cement the separation track 5 and the plane protecting wing 19 that are close to the concrete, The sticky force of them is much greater than the sum the of the support spring's 25 tension add the pull of the plane protecting wing 19 and plastic rivet 22, combine with the lateral frictional resistance between the little female dovetail slot 17 and little dovetail 21'. So, it meet the conditions of the main body 1 upward monomer one-way movement, The main body 1 that be the first into the wall closure 45 is pulled up, and the separation track 5, the plane protecting wing 19 and the protecting shell 44 is left in the diaphragm wall that is new formed; Then vibrate the last diaphragm wall forming equipment 46" while lift up, Because the concrete of the front and back parts of the device is not solidified, the concrete has no big sticking force, So after the last diaphragm wall forming equipment 46" was pulled out; the separation track 5, the plane protecting wing 19; and the protecting shell 19' stay in the concrete wall, and forming a good anti permeability structure.

Of course, the above is only the preferred embodiment of the invention, cannot be considered for defining the invention embodiment range. Invention is not limited to, for example, persons of ordinary skill in the art in the invention of the physical limits of the average change and improvement shall be belonging to the invention of the patent covered within the scope.

What is claimed is:

1. An end-of-wall-closing type wall-forming device for a press-fit underground continuous wall, comprising:

a main body (1), a vibration water spraying device that is fixedly arranged inside the main body (1), and a separation device that is movably sleeved outside a first (short) side (11') of the main body (1), wherein the main body (1) comprises an inner cavity (2), an outer wall body (3), a small external wall body, and a double-flap valve (4), and wherein the inner cavity (2) is an integral hollow rectangular cavity, wherein the outer wall body (3) is formed by two pieces, each having a "7" shape, arranged along long sides (12') of the inner cavity (2), wherein heads of the "7" shapes form, at a center of a first side (11) of the inner cavity (2) a concave dovetail slot (7);

wherein the concave dovetail slot (7) fits a convex dovetail rail (7') on an adjacent automatic wall forming device (46);

a long outer wall body (3") is formed at a joint (8) by a reinforcing plate (9), which is fixed by bolts (35') at distance from the joint (8) between the upper inner cavity (2) and the inner cavity (2); a sealing groove (8') is provided on one side of the joint (8), at a center of a short side wall (11'), two small external small bodies (3') form a vertical concave dovetail groove (17), in which are provided with a protruding shoulder (6), which has a sloped upper surface and a flat bottom surface;

the double-flap valve (4) is arranged at a bottom of the main body (1); a lower end of the main body (1) having the double-flap valve (4) is called a base section (10); a section of the main body (1) without the double-flap valve (4) and abutting the base section (10) is called an auxiliary section (10'), the double-flap valve (4) is divided into two halves at a center of the long side (12') of the inner cavity (2), wherein each of the two halves is provided with a shaft pin hole (13) at a bottom end, and each of the shaft pin holes (13) align with a shaft pin hole (13 ') arranged at a bottom of short sides (11) and (11') of the inner (2) to form a coaxial shaft pin hole, which accommodates a shaft pin (14) to form a hinge connection.

2. An end-of-wall-closing type wall-forming device according to claim 1, wherein the separation device comprises a separating rail (5), a pawl (18) and a wing (19), wherein the separating rail (5) comprises a large convex dovetail track (21) fit in a female dovetail groove (20) of an automatic wall forming device (46), and a small convex dovetail track (21') fit in a small concave dovetail groove (17) on the small outer wall body (3') from a top of the main body (1), wherein at a joint between the large convex dovetail track (21) and the small convex dovetail track (21') are provided with wings (19) on both sides, wherein the wings (19) are fixed, using plastic rivets (22), on outside of the small external wall body (3'), wherein "∟" shaped flaps (19') cover gaps between the small external wall body (3') and the wings (19), a protective cover (44) is arranged at a bottom of the separation rail (5) and the small external wall body (3') and is fixed with the plastic rivet (22);

wherein the pawl (18) and a pawl chamber (24) are horizontally arranged inside the separation rail (5) at a location vertically corresponding to a position of the protruding shoulder (6), and the pawl (18) has a slanted lower side and a flat upper side such that it is in a shape of a door lock plunger, wherein a diameter of a back shoulder (23) of the pawl (18) is larger than a diameter of a pawl shaft (23'), and wherein one end of a supporting spring (25) is disposed in a spring seat (26) on a rear shoulder (23) and a second end of the support spring (25) is in a second spring seat (26) on a guide shaft (27) located at corresponding to an inner wall (24') of the pawl chamber (24), wherein the slanted lower side of the pawl (18) matches the upper slanted side of the protruding shoulder (6).

3. The end-of-wall-closing type wall-forming device of claim 1, wherein the vibration water spraying device comprises a water inlet pipe (28), a water outlet pipe (28'), a circulating water pipe (29), a cable duct (30), an air duct (31), a cooling water pipe (31') an electric vibrator (32) or a gas source vibrator (32'), a vibration chamber (33), a water spray valve (34), and a pipe body, a top end of which is vertically arranged along an outer wall of the long side (12') of the inner cavity (2);

wherein a dome (42) is arranged inside the outer wall body (3), and a pipeline passes through the dome into the vibration chamber (33) and is fixed on the outer wall of the inner cavity (2);

wherein a water spray valve (34) is installed on the vibration wall (36), an outlet (37) of the water spray valve (34) faces outside of the vibration wall (36) and the water spray valve (34) is in communication with the circulating water pipe;

wherein a vibration wall (36) is vertically arranged on a concave shoulder (40) of upper and lower outer wall parts (3) and is horizontally arranged on a vibration frame (41) to form the vibration chamber (33);

wherein the electric vibrator (32) or the air source vibrator (32') is installed inside the vibrating wall (36);

wherein the vibration chamber (33) at a bottom of the base section (10) and the vibration chamber (33) at a top of the auxiliary section (10') are provided with a circulating water pipe (29) that is in series with a cooling water pipe (31'); and wherein the water inlet pipe (28) and the water outlet pipe (28') are connected to a water tank on a static pile.

4. The end-of-wall-closing type wall-forming device of claim 1, wherein the double-flap valve (4) has a triangular shape in an elevation view.

5. The end-of-wall-closing type wall-forming device of claim 1, wherein the double-flap valve (4) comprises two flat plates.

6. A method for closing end-of-wall for a press-fit underground continuous wall, comprising:

Step 1: according to a design of depth and thickness of a diaphragm wall, selecting and assembling an appropriate base section (10) and an auxiliary section (10'), wherein a vertical total length, which is limited by a design elevation construction process conditions, is varied by using auxiliary sections (10') of different lengths, wherein when the base section (10) and the auxiliary section (10') are connected, joints (8) are aligned to prevent water seepage, and threaded holes (35") arranged vertically on an outer wall (3) are also aligned, wherein bolts (35) are used to secure the joints, and a protective cover (44) is fastened with plastic rivets (22) at bottom ends of a separation rail (5) and a small external wall body (3') to prevent muddy water from entering;

Step 2: when a main body (1) is fixed, sliding a small dovetail track (21') on the separation rail (5), from a top of the main body (1), into a small concave dovetail groove (17) so that a pawl (18) touches a protruding shoulder (6), thereby a lower bevel of the pawl (18) slides over an upper bevel of the protruding shoulder (6) in the small concave dovetail groove (17) on a short side (11') of an inner cavity (2), forcing the pawl (18) to convert a vertical movement energy through bevel mechanics to urge a pawl shaft (23) to move a pawl back shoulder (23) to press a supporting spring (25) horizontally along a guide shaft (27) so that the pawl (18) is pushed to retract into a pawl chamber (24), such that the small dovetail track (21') can pass over the protruding shoulder (6) to a predetermined position at a bottom of the base section (10); when a separation device is stuck with concrete and not moving, lifting the main body (1) up, thereby the upper bevel of the protruding shoulder (6) collides with the lower bevel of the pawl (18), and the pawl (18) is pushed to retract into the pawl chamber (24) such that the protruding shoulder (6) passes over the pawl (18), and the main body (1) can continue to ascend until it is pulled out of the ground; pushing the main body (1) and the separation device into ground, thereby a flat lower surface of the protruding shoulder (6) bumps against an upper flat surface of the pawl (18), wherein the small dovetail (21') is limited to a vertical movement due to confine of the small concave dovetail groove (17), thereby the protruding shoulder (6) drives the pawl (18) to drive and, therefore, the separation device down until it arrives at a predetermined underground place;

Step 3: pushing an end-of-wall-closing wall-forming device (45) into ground along an axis of an underground diaphragm wall, sliding the dovetail groove (7) on a first automatic wall-forming device (46) on a dovetail track (21) on the end-of-wall-closing wall-forming device (45) and pressing the first automatic wall-forming device (46) into the ground, filling it with concrete, and then using a static pile driver to insert a dovetail groove (7) on a second automatic wall-forming device (46') onto a dovetail track (7') on the first automatic wall-forming device (46) and pressing the second automatic wall-forming device (46') into the ground, filling it with concrete and slowly raising the first automatic wall-forming device (46), wherein a double-flap valve (4) opens under action of gravity, thereby concrete in the inner cavity (2) flows out to fill a void left by raising the main body (1) to form a first segment of an underground wall unit, wherein the separation device does not follow the first automatic wall-forming device (46) out and remains attached to the end-of-wall-closing wall-forming device (45), and wherein the concrete flowing out of the first automatic wall-forming device (46) adheres to outside of the separation rail (5) and a wing (19), wherein when construction of underground continuous wall reaches an end for enclosure, inserting a dovetail track (7') on a last automatic wall-forming device (46") into a dovetail groove (7) on the end-of-wall-closing wall-forming device (45), and pressing the last automatic wall-forming device (46") to a same depth underground to complete mechanical closure between the end-of-wall-closing wall-forming device (45) and the last automatic wall-forming device (46"), filling concrete into the end-of-wall-closing wall-forming device (45) and the last automatic wall-forming device (46"), starting an electric vibrator (32) or an air-powered vibrator (32') and gradually raising the end-of-wall-closing wall-forming device (45), thereby the main body (1) of the end-of-wall-closing wall-forming device (45) is pulled out and the separation rail (5), the wing (19), and the protective cover (44) are left in newly formed concrete underground continuous wall; and lifting the last automatic wall-forming device (46") while vibrating, thereby the last automatic wall forming device (46") is pulled out because no concrete has solidified, while the separation rail (5), the wing (19), and an "z,21 " flap (19') are left in a concrete wall section to form an impermeable structure.

* * * * *